United States Patent [19]

Stratton

[11] 4,311,277

[45] Jan. 19, 1982

[54] FUEL INJECTOR

[75] Inventor: John F. Stratton, Blackburn, England

[73] Assignee: Lucas Industries Limited, Birmingham, England

[21] Appl. No.: 50,555

[22] Filed: Jun. 20, 1979

[51] Int. Cl.[3] ..... B05B 7/10

[52] U.S. Cl. ..... 239/400; 239/403

[58] Field of Search ..... 239/400, 403, 404, 405, 239/413, 419.3, 422, 425, 426, 427.5, 431, 434; 431/284

[56] References Cited

U.S. PATENT DOCUMENTS

| | | | |
|---|---|---|---|
| 2,933,259 | 4/1960 | Raskin | 239/405 |
| 3,285,007 | 11/1966 | Carlisle et al. | 60/39.74 |
| 3,684,186 | 8/1972 | Helmrich | 239/400 |
| 3,958,759 | 5/1976 | Timoney | 239/434 |
| 4,002,297 | 1/1977 | Pillard | 239/433 |
| 4,141,505 | 2/1979 | Reich | 239/431 |

FOREIGN PATENT DOCUMENTS

| | | | |
|---|---|---|---|
| 2750253 | 5/1978 | Fed. Rep. of Germany | 239/400 |
| 2163494 | 12/1972 | France | 239/431 |
| 2336556 | 9/1976 | France | 239/431 |
| 1470671 | 4/1977 | United Kingdom | 239/431 |

*Primary Examiner*—Robert B. Reeves
*Assistant Examiner*—Gene A. Church
*Attorney, Agent, or Firm*—Holman & Stern

[57] ABSTRACT

A dual fuel injector has a body in which first, second and, optionally, third flow passages are provided. The first passage feeds liquid fuel to a first ring of outlet orifices which discharge into the second passage. The second passage leads to a second ring of outlet orifices which are aligned with orifices in the first ring and which are of greater cross-sectional area than the latter. The orifices of both rings lie on axes which are disposed at an acute angle (e.g. 45°) to the longitudinal axis of the body so that a conical discharge of fuel and air is obtained in use. The second passage is an air passage when liquid fuel is being injected and may be an air passage or a gaseous fuel passage when the optional third passage is employed and the injector is in its gaseous fuel injection mode.

4 Claims, 4 Drawing Figures

FUEL INJECTOR

BRIEF SUMMARY OF THE INVENTION

This invention relates to a fuel injector for use particularly, but not exclusively, in gas turbine engines.

It is a disadvantage of existing fuel injectors intended for use in low pressure (100lb/sq in.) fuel systems of wide flow range provided for gas turbine engines that a good quality of atomisation is not obtained at relatively low liquid fuel pressures, e.g. under ignition and idling conditions.

An object of the present invention is to provide a fuel injector which is constructed so as to produce a good quality atomisation of liquid fuel, particularly at relatively low fuel pressures with relatively large fuel flow rates, i.e. at relatively large fuel apertures.

An object of a preferred embodiment is to enable dual fuel operation, i.e. the possibility of injecting either liquid or gaseous fuel from the fuel injector.

According to the present invention, there is provided a fuel injector assembly comprising an elongate body, first and second passages extending longitudinally of the body, said first passage being a liquid fuel passage and said second passage being an air passage in at least one mode of use of the injector, a first ring of outlet orifices in the body communicating with the first passage, and a second ring of outlet orifices in the body communicating with the second passage, each outlet orifice of the first ring opening into the second passage in substantial alignment with a respective outlet orifice of the second ring, each outlet orifice of the second ring being of greater cross-sectional area than the respective outlet orifice of the first ring, and the orifices of the first and second rings lying on axes which are disposed at an acute angle with respect to the longitudinal axis of the body so that, in use, a fuel and air mixture is ejected from the orifice in the second ring to blend together to form a substantially conical discharge.

Preferably, the orifices are all disposed with their axes at an angle of 45° relative to the longitudinal axis of the body.

In a first embodiment, an end wall of the body has at least one inlet opening providing communication between the second passage and the exterior of the body adjacent said end wall.

In a second embodiment, the body has a third passage therein which is an air passage and the second passage is an air passage in one mode of use and a gaseous fuel passage in another mode of use, said first passage being a liquid fuel passage in said one mode of use and not being used in said another mode of use, and a third ring of outlet orifices are provided in the body, the orifices of the first ring communicating with the third passage and being aligned with respective orifices of the first and second sets, the orifices of the second ring being disposed between the orifices of the first ring and the third ring and the orifices of the third ring having a cross-sectional area which is greater than the corresponding orifices of the first and second rings.

In this second embodiment, it is preferred for the body to be provided with an inlet opening therethrough providing communication between the third passage and the exterior of the body adjacent said inlet opening.

In both of the above-described embodiments, it is preferred for a plurality of holes to be provided in an end of said body which is to be disposed, in use, in said flame tube, said holes communicating, in said one embodiment with the second passage and in said second embodiment, with said third passage.

In a third embodiment, the second passage is an air passage in liquid fuel and in gaseous fuel modes of use and is fed with air through an inlet opening onto the upstream end of the body. In the third embodiment, a third passage is preferably provided in the body for passage of air in use.

Preferably, the third passage terminates in an outlet which is surrounded by an annular lip directed inwardly of the body, the outlet being arranged so that the fuel-/air mixture ejected from the second ring of orifices passes therethrough. This form of construction provides a more uniform conical discharge of the fuel and air mixture.

In a particularly preferred form of the third embodiment, a gas supply passage communicates with the third passage. Preferably, the gas supply passage opens into the third passage downstream of the air swirler arrangement.

BRIEF DESCRIPTION OF THE SEVERAL VIEWS OF THE DRAWING

Embodiments of the present invention will now be described, by way of example, with reference to the accompanying drawings in which.

DETAILED DESCRIPTION

Figure 1:
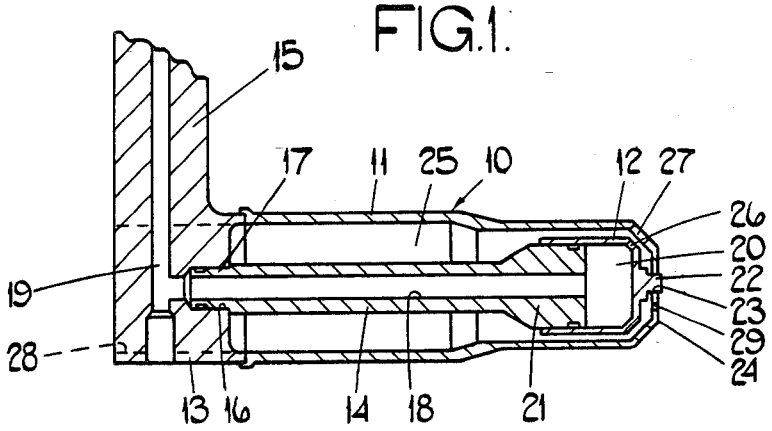
FIGS. 1, 2 and 3 are axial sectional views of first, second and third embodiments respectively, of a fuel injector according to the present invention.

Referring now to FIG. 1, the fuel injector is for mounting in a flame tube and comprises an elongate composite body 10 composed of an outer shell portion 11, an inner shell portion 12, a hollow end block 13, and an elongate sleeve 14. The hollow end block 13 is integral with a support arm 15 by which the body 10 is supported within a ring of air swirler blades at the inlet end of a flame tube (not shown) and is supplied with fuel in a manner to be described hereinafter. The hollow end block 13 has a bore 16 in which one end 17 of the sleeve 14 is engaged. A bore 18 in the sleeve 14 communicates with a counterbore 19 in the block 13 and support arm 15. Liquid fuel is supplied, in use, through said counterbore 19. The opposite end of the bore 18 in the sleeve 14 opens into a chamber 20 defined by the inner shell 12 and the sleeve 14, the inner shell 12 being mounted on an enlarged end portion 21 of the sleeve 14. The inner shell 12 is provided with an integral projection 22 which engages in an aperture 23 in an end wall 24 of the outer shell portion 11. The end of the outer shell portion 11 remote from said end wall 24 is welded to the end block 13. There is thus defined in the body 10, first and second passages extending longitudinally thereof, the first passage being formed by the bore 18 and the chamber 20 and the second passage being formed by a stepped annular space 25 between the assembly of sleeve 14 and inner shell 12, and the outer shell portion 11. At the end of the inner shell 12 adjacent the end wall 24, there is provided a ring of outlet orifices 26 (only one shown), forming a first ring of outlet orifices. Each orifice 26 is disposed so that its axis lies at an angle of 45° relative to the longitudinal axis of the body 10. In this embodiment, nine equiangularly spaced outlet orifices 26 are provided, with one orifice 26 lying vertically above the longitudinal axis of the body 10 when the latter is disposed with the support arm 15 extending vertically upwardly from the body 10. Each orifice 26 provides communication between the chamber 20 and the annular space 25 adjacent the end wall 24. A ring of outlet orifices 27, forming a second ring of outlet orifices, is formed in the outer shell portion 11 adjacent the end wall 24. Each outlet orifice 27 is co-axial with respect to a respective one of the orifices 26 whereby each orifice 27 is disposed with its axis at 45° with respect to the longitudinal axis of the body 10. The orifices 26 and 27 are of circular cross-section. The orifices 26 are all of the same cross-sectional area, as are the orifices 27, but the orifices 27 have a greater cross-sectional area than the orifices 26.

At the opposite end of the body 10 to the end wall 24, the hollow end block 13 is formed with a pair of kidney shaped inlet ports 28 lying on opposite sides of the counterbore 19. The inlet ports 28 communicate with the annular space 25. A further ring of outlet holes 29 are provided in the end wall 24 around the projection 22, each hole 29 being of smaller diameter than those of the orifices 26 and 27.

In use, air passes into the body 10 through the inlet ports 28 and flows along the annular passage 25 to leave the body 10 through the outlet orifices 27 for the most part; whilst some of the air leaves the body 10 through the holes 29. Fuel is passed into the body 10 through the bore 19 and along the bore 18 to be discharged from the outlet orifices 26 after passing into the chamber 20. The fuel leaving the orifices 26 is entrained with air passing along the annular passage 25 so that a fuel/air mixture is discharged from the orifices 27 into the swirling airstream produced by the aforementioned swirler blades. Due to the above-described arrangement of the orifices 26 and 27, an expanding conical spray is provided to inject a fuel/air mixture into the air flow pattern within the flame tube. Air passing out of the body 10 through the holes 29 serves to eliminate the build-up of carbon on the outside of the end wall 24 in use. The quality of atomisation produced by the above-described fuel injector is good particularly at the lower fuel pressures which exist at the lower end of the effective operating range of the flame tube, i.e. under ignition and idling conditions.

Figure 2:
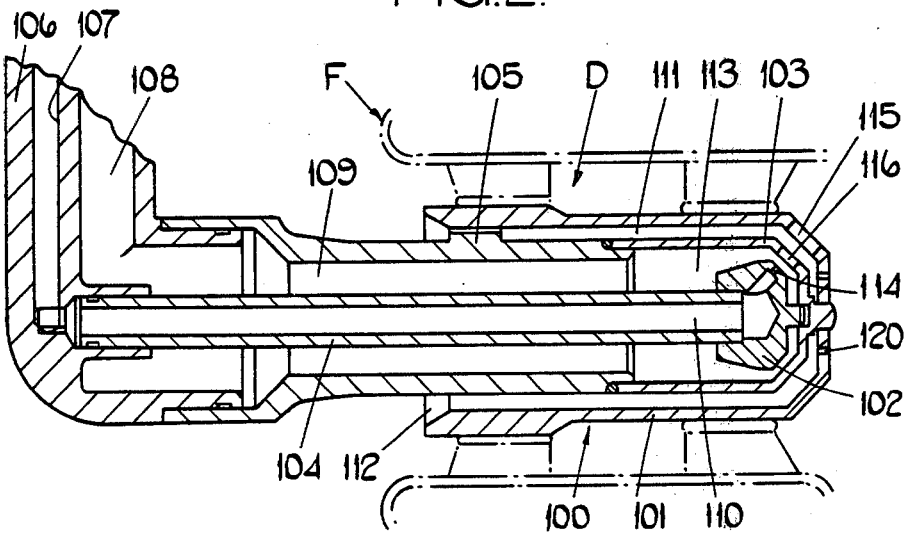

Referring now to FIG. 2, the fuel injector illustrated therein is also intended to be used in a flame tube (partially shown in dotted line at F) and is intended to be used in conjunction with an annular bladed air-swirler D surrounding the injector. The fuel injector comprises a body 100 comprising an outer shell portion 101, an inner shell portion 102, an intermediate shell portion 103, a first inner sleeve 104, and a second inner sleeve 105. The body 100 is mounted co-axially within the bladed air swirler device D and is connected to a support arm 106 provided with a liquid fuel passage 107 communicating with the interior of the inner sleeve 104 and a gaseous fuel or air passage 108 communicating with an annular space 109 defined between the sleeves 104 and 105. The interior of the sleeve 104 opens into the interior of the inner shell portion 102 to define therewith a first passage 110. A second passage 111, of annular form, is defined between the outer shell portion 101 and the intermediate shell portion 103 and is provided with an annular inlet portion 112 at one end of the outer shell portion 101. The space 109 communicates with an annular space 113 defined within the shell portion 103 around the shell portion 102 and adjacent end of the sleeve 104. The first passage 110 is provided with a ring of outlet orifices 114 whose axes are inclined at an angle of 45° with respect to the longitudinal axis of the body 100. The second passage 111 is provided with a ring of outlet orifices 115 which are arranged co-axially with respect to the orifices 114, the arrangement and disposition of the sets of orifices 114 and 115 being the same as described hereinabove in relation to the sets of orifices 26 and 27 of the embodiment of FIG. 1. A third set of orifices 116 is provided in the shell portion 103, with the orifices 116 being aligned with respective orifices 114 and 115. A ring of small orifices 120 are provided inwardly of the ring of third orifices 115 and serve as anti-carbon orifices in a similar manner to the orifices 29 of the fuel injector of FIG. 1.

In use, in one mode of operation of the fuel injector, liquid fuel is passed along the bore 107 and the passage 110 to be discharged through the orifices 114. At the same time, air is pumped separately along the passage 108 to flow through the spaces 109 and 113 to be discharged through the orifices 116. Also, air passes into the second passage 111 through the inlet port 112 to be discharged through the orifices 115. The liquid fuel is thereby intimately mixed with air as it passes successively through the respective orifices 116 and 115 so that an expanding conical discharge of fuel and air is provided. As in the case of the first embodiment, this arrangement provides an efficient atomisation particularly at low fuel pressures. This expanding conical fuel/air discharge enters the swirling air stream produced, in use, by the air swirler D.

In another mode of operation of the atomiser, the flow of liquid fuel is stopped and the passage 108 is connected with a pumped supply of gaseous fuel. Air is continued to be supplied to the atomiser assembly through the inlet port 112 so that gaseous fuel is discharged through the orifices 116 to be mixed with the air flowing along passage 111 whereby a gaseous fuel/air mixture is discharged through the orifices 115 into the swirling air flow downstream of the bladed air swirler device D.

Figure 3:
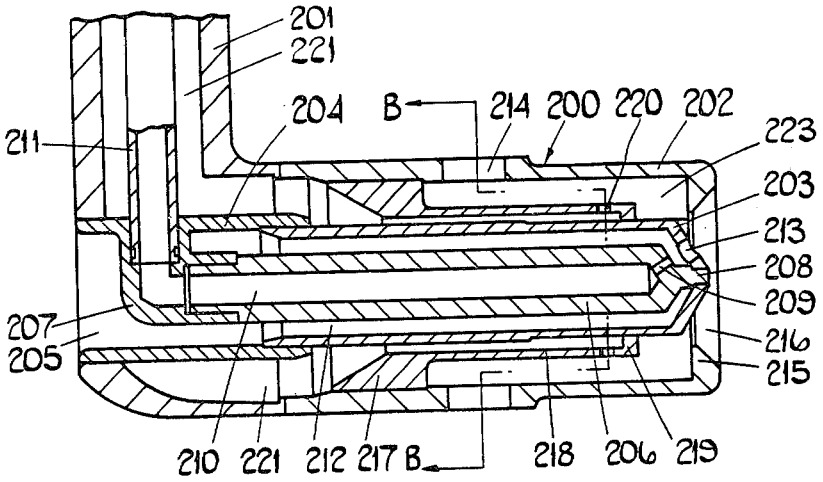
Figure 4:
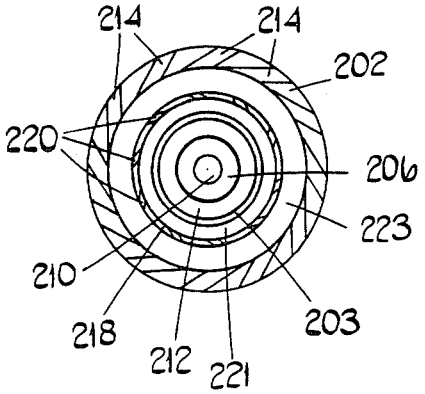
FIG. 4 is a sectional view on the line B-B of FIG. 3, where for clarity the section lines have been omitted.

Referring now to FIGS. 3 and 4, the fuel injector illustrated therein is also intended to be used in a flame tube within a ring of air swirler blades and comprises a composite elongate body 200 carried by a hollow support arm 201. The body 200 has an outer shell portion 202 which is welded to the support arm 201. The body 200 also has an inner shell portion 203 and a sleeve portion 204. One end of the inner shell portion 203 is sealingly fitted into an inner end of the sleeve portion 204 to be supported thereby. The sleeve portion 204 is sealingly supported in an aperture in the arm 201 so that an open end 205 of the sleeve portion 204 is exposed at the upstream end of the body 200. Disposed within the inner shell portion 203 is a liquid fuel supply tube 206. The liquid fuel supply tube 206 is sealingly supported at its upstream end in a right-angle union 207 integrally formed in the sleeve portion 204. The tube 206 is provided with a spigot 208 at its downstream end, the spigot 208 being engaged with the inner shell portion 203 to hold the tube 206 co-axially within the latter. At its end bearing the spigot 208, the tube 206 is provided with a ring of first orifices 209 (only one shown) which are inclined at an acute angle (in this embodiment 45°) to the longitudinal axis of the body 200.

A first passage 210 is defined within the tube 206 and provides communication between the first orifices 209 and the right angle union 207 which is fed with liquid fuel, in one mode of use, from a pump (not shown) via a tube 211. The tube 211 extends longitudinally of the support arm 201 and is sealingly engaged in the union 207. A second annular passage 212 is defined in the body 200 between the tube 206 and the inner shell portion 203 and within the sleeve portion 204. The second annular passage 212 is an air passage and has an inlet formed by the open end 205 of the sleeve portion 204. At the opposite end of the passage 212 to the open end 205 are a ring of second orifices 213 (only one shown) which are aligned with the ring of first orifices 209. A third passage 223 is defined between the outer shell portion 202 and the inner shell portion 203. This third passage 223 is fed with air at an upstream end thereof via a series of inclined slots 214 extending through the shell portion 202. These inclined slots 214 are shown in greater detail in FIG. 4 and they impart a swirl to air entering the third passage 223 because they have a tangential component of direction. Thus air passing along the third passage 223 swirls in a helical fashion. The outer shell portion 202 has an integral, inwardly directed annular lip 215 which defines an outlet 216 at a downstream end of the body 200. The lip 215 has a radially directed inner surface which faces the passage 223 and a flared, frusto-conical outer surface. The second orifices 213 discharge into the outlet 216 and are substantially in line with the inner periphery of the lip 215. The upstream end of the passage 223 is defined by an annular element 217 having an integral sleeve portion 218 extending therefrom axially of the passage 223 to terminate downstream of the slots 214. The sleeve portion 218 has an inwardly directed annular flange 219 at its downstream end. The flange 219 engages closely around the inner shell portion 203 but is slidable relative thereto. Immediately behind the flange 219 in the upstream direction, but downstream of the slots 214, the sleeve portion 218 has a ring of inclined slots 220 therethrough. The slots 220 have a tangential direction of extent but are orientated in the opposite sense to the slots 214. (see FIG. 4). A gaseous fuel passage 221 extends between the sleeve portion 218 and the shell portion 203, between the outer shell portion 202 and the sleeve portion 204 and through the support arm 201. This passage 221 is fed with gaseous fuel by means of an external pump (not shown).

In one mode of operation of the fuel injector, the gaseous fuel pump is not operated so that the passage 221 and slots 220 are un-used. Liquid fuel to be injected is pumped along the tube 211, through the union 207 and along the tube 206 to be discharged through the first orifices 209. Simultaneously, air passes through the second passage 212 via the open end 205 and is discharged along with the fuel from the orifices 209 through the ring of second orifices 213 in a manner similar to that described with reference to FIG. 2 whereby a conical discharge of fuel and air is obtained. Meanwhile, further air passes through the inclined slots 214 and the resultant swirling air flow passes along the third passage 223 to be discharged through the outlet 216 after being deflected radially inwardly by the inner surface of the lip 215. The air flow thus created "pulls out" the conical discharge of fuel and air from the orifices 213 to increase the cone angle thereof, ensures a more uniform discharge and further improves atomisation of the liquid fuel. Thus, the use of a separately pumped air supply is avoided.

In a second mode of operation of the fuel injector, flow of liquid fuel is stopped and the gaseous fuel pump is operated to cause gaseous fuel to pass along the passage 221 and discharge from the slots 220 into the third passage 223 downstream of the slots 214. The gaseous fuel from the slots 220 has a swirl imparted thereto by the slots 220 and is entrained in the swirling airstream in the passage 223 and discharged through the outlet 216 together with air from the second passage 212 discharged through the orifices 213.

Thus, a thorough mixing of the gaseous fuel and air occurs in the passage 223 before discharge through the outlet 216. Because of the relative orientation of the orifices 214 and 220, the gaseous fuel and air are swirled in the same direction thus minimising the pressure loss associated with the mixing process.

I claim:

1. A fuel injector assembly comprising an elongate body, means defining first and second passages extending longitudinally of the body, said first passage being a liquid fuel passage and said second passage being an air passage in at least one mode of use of the injector, an air inlet opening through the body communicating with the upstream end of said second passage, a first ring of outlet orifices in the body communicating with the first passage, a second ring of outlet orifices in the body communicating with the second passage, each outlet orifices of the first ring opening into the second passage in substantially coaxial alignment with a respective outlet orifice of the second ring, each outlet orifice of the second ring being of greater cross-sectional area than the respective outlet orifice of the first ring, and the orifices of the first and second rings lying on axes which are disposed at an acute angle with respect to the longitudinal axis of the body so that, in use, a fuel and air mixture is ejected from the orifice in the second ring to blend together to form a substantially conical discharge, a third passage for air extending longitudinally of said body having an outwardly flared frustoconical outlet orifice defined by a radially inwardly directed annular lip, the inner periphery of said frustoconical orifice being substantially coaxially disposed about said second ring of outlet orifices and radially spaced therefrom to direct air from said third passage radially inwardly towards said second ring of outlet orifices so that the fuel/air mixture ejected from said second ring of outlet orifices passes through said frustoconical orifice.

2. A fuel injector as claimed in claim 1 and further comprising a fourth longitudinal passage in the body for the passage of gaseous fuel communicating with said third passage.

3. A fuel injector assembly as claimed in claim 2, wherein said third passage has an air swirler therein and said fourth passage communicates with said third passage downstream of said air swirler.

4. A fuel injector assembly as claimed in claim 3, wherein said third and fourth passages are annular in shape and coaxially disposed with respect to each other, said swirler means comprises first slots through said body for conveying air to said third passage, said slots being at an angle with respect to said third passage to impart a helical-tangentially directed swirl of the air passing through the annulus of said third passage, and said communication between said third and fourth passages comprises second slots through said body between said two annulae downstream of said first slots, said second slots being at an angle with respect to said third and fourth passages to impart a helical-tangentially direction swirl to the gaseous fuel passing therethrough in the same direction as the swirl produced by said first slots.

* * * * *